US006944413B2

(12) United States Patent
Maeda

(10) Patent No.: US 6,944,413 B2
(45) Date of Patent: Sep. 13, 2005

(54) IMAGE FORMING APPARATUS FOR PREVENTING THE ADHESION OF DISCHARGE PRODUCTS IN A CHARGER THEREBY PREVENTING IMAGE DEFECTS

(75) Inventor: Masahiro Maeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 23 days.

(21) Appl. No.: 10/445,309

(22) Filed: May 27, 2003

(65) Prior Publication Data

US 2005/0074254 A1 Apr. 7, 2005

(30) Foreign Application Priority Data

May 27, 2002 (JP) ..... 2002-152046
May 27, 2002 (JP) ..... 2002-152047
May 27, 2002 (JP) ..... 2002-152048
May 27, 2002 (JP) ..... 2002-152049

(51) Int. Cl.[7] ..... G03G 15/02

(52) U.S. Cl. ..... 399/92; 399/100; 399/170; 399/172

(58) Field of Search ..... 399/92, 93, 98, 399/100, 170–172; 250/324–326

(56) References Cited

U.S. PATENT DOCUMENTS 4,864,363 A 9/1989 Shinada
4,922,303 A * 5/1990 Takeda et al. ..... 399/92
5,012,093 A 4/1991 Shimizu
5,018,045 A 5/1991 Myochin et al.
5,291,247 A 3/1994 DeCecca
5,485,251 A 1/1996 Kita et al.
5,612,768 A 3/1997 Kim et al.
6,070,026 A 5/2000 Claflin, Jr. et al.
6,339,688 B1 1/2002 Cho et al.
6,397,024 B1 * 5/2002 Rejewski et al. ..... 399/92

FOREIGN PATENT DOCUMENTS

EP 0778502 A1 6/1997
JP 6-43815 Y2 11/1994

OTHER PUBLICATIONS

Japanese Abstract No. 61015163, dated Jan. 23, 1986.
European Search Report.

* cited by examiner

*Primary Examiner*—William J. Royer
(74) *Attorney, Agent, or Firm*—Sughrue Mion, PLLC

(57) ABSTRACT

An image forming apparatus includes an image carrier (1), a corona charger (5) in which a discharge electrode (11) is arranged in a conductive shield (9) having an open face on a side facing the image carrier (1) and a face in which a first ventilation opening (10) is formed, and a duct (6) arranged adjacent to the corona charger (5), has an airflow opening (7). The conductive shield is provided with a wall member (22) at an end thereof on the downstream side in the direction of airflow created through the first ventilation opening and is provided with a second ventilation opening (23) in a face on the downstream side in the rotational direction of an image carrier and the duct has a third ventilation opening (24) facing the second ventilation opening and a fourth ventilation opening (25) in a face of the duct.

7 Claims, 4 Drawing Sheets

IMAGE FORMING APPARATUS FOR PREVENTING THE ADHESION OF DISCHARGE PRODUCTS IN A CHARGER THEREBY PREVENTING IMAGE DEFECTS

BACKGROUND OF THE INVENTION

The present invention relates to an image forming apparatus of electrophotographic type. Further, the present invention relates to an image forming apparatus of electrophotographic type having a corona charger provided with a cleaning member. In an image forming apparatus of electrophotographic type, a photoreceptor is uniformly charged to a predetermined electric potential and, after that, is exposed to light to form an electrostatic latent image on the photoreceptor. Then, the electrostatic latent image is developed with toner and transferred to a recording medium and the transferred image is fixed. In this manner, image formation is conducted.

As a means of uniformly charging the photoreceptor of such an image forming apparatus, a corona discharging device called a scorotron charger is well known. The scorotron charger has been widely used because it can uniformly charge the surface of the photoreceptor with a simple structure. However, the scorotron charger utilizes discharge phenomenon, generating discharge products such as ozone and nitrogen oxides. If such discharge products adhere to the photoreceptor or the charger, image deterioration may be caused, as known in the art. For this, a method for ventilation has been proposed (for example, Japanese Utility Model Publication No. H6-43815). According to this method, an image forming apparatus is provided with an opening for sending air in the longitudinal direction in the back side of the charger and a duct for blowing air to the back side of the charger. By blowing air from one end of the duct to create airflow in the charger through the opening, ozone is exhausted.

However, the proposed method for exhausting ozone has a problem that the successive corona discharge intensifies deterioration of a discharge electrode near the end on the downstream side in the direction of airflow in the charger. As a result, the discharge on the downstream side in the direction of airflow becomes unstable, thus creating a significant defect on a position corresponding to an image. Particularly in case of a halftone image, the difference in density between a right half and a left half of an image maybe intensified.

We studied the cause of this problem and found the following. When a photoreceptor drum is rotated, drum wind created by the rotation of the photoreceptor drum is blown into the charger through an opening on a side of the charger facing the photoreceptor drum and air in the duct is blown into the charger through a ventilation opening on a side of the charger opposite to the side facing the photoreceptor drum. The air is blown into the charger through both the opening on the side of the photoreceptor drum and the opening on the side facing the duct as mentioned above so that ozone stays in the charger at the end in the direction of airflow, thus locally intensifying the adhesion of discharge products.

In particular, under a low temperature and low humidity condition (for example, temperature of 10° C., humidity 15%), since the amount of $H_2O$ as carrier of corona discharge is small, the corona discharge is easily unstable, leading to significant adverse effect of the adhesion of discharge products. Therefore, unignorable image defects and density defects are sometimes caused.

Conventionally, a conductive shield composing the charger is provided with a ventilation opening through which air is blown to exhaust ozone to prevent the ozone from staying, thereby preventing adhesion of discharge products on the photoreceptor and the discharge electrode.

However, according to this method, it is required to form the ventilation opening for blowing air into the charger. However, when the ventilation opening is formed in a portion corresponding to the image forming area of the photoreceptor, the position or the shape of the opening may adversely affect the discharge so that the photoreceptor can not be uniformly charged, thus leading to occurrence of image defects such as vertical linear stains on obtained images.

There is also a problem that the adhesion of other matters such as toner or silicone oil onto the discharge electrode also unsettles the discharge, leading to occurrence of an abnormal image. For this, conventionally, a cleaning member is provided which is moved in the tensioning direction while being in contact with the discharge electrode to clean the discharge electrode.

However, as the cleaning member is arranged such that its standby position is on the downstream side in the direction of blown air, the cleaning member in the standby position is contaminated with foreign matters such as scattered toner created during an image forming operation, causing a problem that the cleaning member can not conduct the cleaning operation well or a problem that the contaminated cleaning member adversely contaminates the discharge electrode.

SUMMARY OF THE INVENTION

It is an object of the present invention to provide an electrophotographic apparatus employing a charger utilizing corona discharge, in which the maintenance of well discharge can be achieved by simple structure even under low temperature and low humidity condition.

It is another object of the present invention to provide an image forming apparatus of electrophotographic type employing a charger utilizing corona discharge, in which the occurrence of image defects such as vertical linear stains can be prevented and deterioration due to ozone can be prevented by a simple structure.

It is still another object of the present invention to provide an image forming apparatus of electrophotographic type employing a charger utilizing corona discharge, in which a cleaning member is never contaminated due to air blown in the charger.

For this, the first invention is an image forming apparatus including at least: an image carrier which is movable; a corona charger which is arranged to face said image carrier and comprises a conductive shield having at least an open face on a side facing said image carrier and a face in which a first ventilation opening is formed, and a discharge electrode arranged in said conductive shield; and a duct which is arranged adjacent to said conductive shield and is provided with an airflow opening in one of the ends thereof in the axial direction of said image carrier, wherein air is sent or sucked through the airflow opening which is formed in one of the ends of said duct in the axial direction of the image carrier, and is characterized in that said conductive shield is provided with a wall member at an end thereof on the downstream side in the direction of airflow created in the conductive shield through said first ventilation opening and provided with a second ventilation opening near the end thereof on the downstream side in the direction of airflow.

The second invention is an image forming apparatus including at least: an image carrier which is movable; a corona charger which is arranged to face said image carrier and comprises a conductive shield having an open face on a side facing said image carrier and a face which is opposite to the open face and has a first ventilation opening, and a discharge electrode arranged in said conductive shield; and a duct which is arranged adjacent to said corona charger and is provided with an airflow opening in one of the ends thereof in the axial direction of said image carrier, wherein air is sent or sucked through the airflow opening which is formed in one of the ends of said duct in the axial direction of the image carrier, and is characterized in that said conductive shield is provided with at least one second ventilation opening in a face(s) other than the open face facing said image carrier and the face opposite to the open face on the downstream side in the direction of airflow, and that said duct has a third ventilation opening at a position facing said second ventilation opening of said conductive shield and a fourth ventilation opening in the face, in which the third ventilation opening is formed, near the outlet of the duct.

The third invention is an image forming apparatus including at least: an image carrier which is movable; and a corona charger which is arranged to face said image carrier and comprises a conductive shield having an open face facing said image carrier and at least one ventilation opening, and a wire-like discharge electrode surrounded by said conductive shield, and is characterized in that said conductive shield has at least one proximate face which is located at a position nearest to said discharge electrode and at least one second ventilation opening formed in a face thereof, other than the proximate face, which is not located at a position nearest to said discharge electrode.

The fourth invention is an image forming apparatus including at least: an image carrier which is movable; a corona charger which is arranged to face said image carrier and has a cleaning member for cleaning a wire-like discharge electrode surrounded by a conductive shield; a duct which is arranged adjacent to said conductive shield and has an airflow opening formed in one of the ends thereof in the axial direction of said image carrier, wherein air is sent or sucked through said airflow opening, and is characterized in that said cleaning member is designed to stay at a standby position on the upstream side in the direction of airflow when it is inoperative.

DESCRIPTION OF THE PREFERRED EMBODIMENTS

Hereinafter, embodiments according to the present invention will be described with reference to the drawings.

Figure 1A:
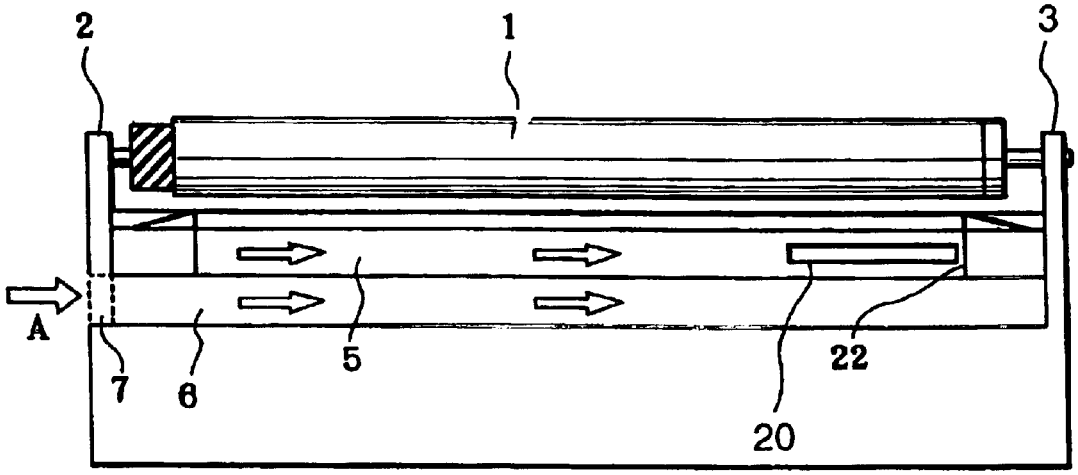
FIGS. 1(*a*), 1(*b*) are illustrations showing a first embodiment of an image forming apparatus of the present invention.
Figure 1B:
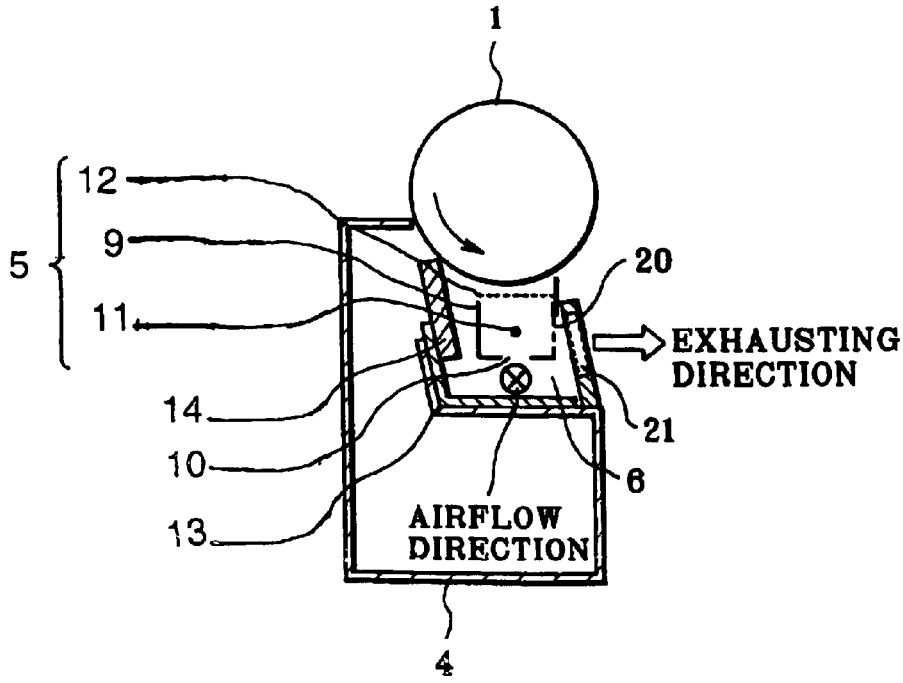

FIGS. 1(*a*), 1(*b*) are illustrations showing a first embodiment of an image forming apparatus, wherein FIG. 1(*a*) is a longitudinal sectional view thereof and FIG. 1(*b*) is a cross sectional view thereof.

A drum-like image carrier 1 is rotatably supported by side plates 2, 3. In a cartridge 4, a corona charger 5 is disposed to face the image carrier 1 and a duct 6 is disposed adjacent to the corona charger 5. The corona charger 5 comprises a discharge electrode 11 arranged to extend along the axial direction of the image carrier 1, a conductive shield 9 having a U-like section surrounding the discharge electrode 1, and a grid 12 formed in the open face of the conductive shield 9 facing the image carrier 1. The conductive shield 9 has a face in which a ventilation opening 10 is formed to extend along the discharge electrode 1. The duct 6 is arranged to extend along the ventilation opening 10 and has an opening 7 (this opening may also be referred to as an "airflow inlet") formed in at least one of the side plates 2, 3. An air blower, which is rot shown, is disposed to the opening 7 to send air into the duct 6 to create airflow in the conductive shield 9 through the ventilation opening 10. The duct 6 is provided with a supporting member 13 to which a cleaning blade 14 is mounted for cleaning residual toner on the surface of the image carrier 1 so that the residual toner is collected in the cartridge 4.

In the first embodiment, the end of the conductive shield 9 on the downstream side in the direction of airflow is closed with a wall member 22. The conductive shield 9 is provided with a ventilation opening 20 formed in a side face thereof near the end on the downstream side in the direction of airflow over a predetermined length. The ventilation opening 20 is 8 not limited to one continuous opening and may be composed of a plurality of openings formed along the side face of the conductive shield 9. A duct opening 21 is formed to face the ventilation opening 20.

In the image forming apparatus having the aforementioned structure, as air is sent through the airflow inlet 7 by the air blower as shown by arrow A, air sent into the duct 6 creates airflow in the conductive shield 9 through the ventilation opening 10 formed in the conductive shield 9 so that air is blown in the same direction as in the duct 6, whereby ozone generated in the conductive shield 9 by discharge of the corona charger 5 gathers at the downstream side in the direction of airflow. Since the end of the conductive shield 9 on the downstream side in the direction of airflow is closed with the wall member 22, air collides with the wall member 22, thereby causing turbulent flow and thus changing the direction of flow. Therefore, the air is exhausted with ozone through the ventilation opening 20 and the ventilation opening 10 to the duct 6 and is further exhausted through the duct opening 21. In this manner, ozone gathering at the downstream side in the direction of airflow is effectively exhausted because of the turbulent flow. A suction unit (not shown) is disposed outside the duct opening 21 to suck the air with ozone, thereby further effectively exhausting the ozone.

The duct 6 also has an opening at its end (where the side plate 3 is positioned) on the downstream side in the direction of airflow so that air is also exhausted in the axial direction of the duct 6. The end of the duct 6 may be closed by a wall member 22 so that air is exhausted only through the duct opening 21. Though the duct 6 is arranged below the conductive shield 9 in the illustrated example, the duct 6 may be arranged side by side with the conductive shield 9 so that air is sent to cause airflow both in the duct 6 and the conductive shield 9 and exhausted from the side of the conductive shield 9.

Though the example in which air is sent through the airflow inlet 7 has been described in the above, the duct 6 may be provided with openings at both ends such that air may be sucked at the airflow inlet 7. In this case, the suction side becomes the downstream side in the direction of airflow to provide the same effect of exhausting ozone.

According to the first embodiment as mentioned above, the wall member 22 is provided to close the end of the conductive shield 9 on the downstream side in the direction of airflow in the conductive shield 9 of the corona charger 5. By this wall member 22, turbulent flow is created to change the direction of airflow so that air is exhausted through the ventilation opening 20 formed near the end on the downstream side in the direction of airflow. Therefore, ozone staying around the end of the conductive shield 9 on the downstream side in the direction of airflow can be effectively exhausted, thereby preventing the adhesion of discharge products onto the discharge electrode 11. Therefore, well discharge can be conducted even under a low temperature and low humidity condition. Further, by disposing a suction means outside the duct 6, ozone at the end on the downstream side in the direction of airflow can be further effectively exhausted, thus much surely preventing the adhesion of discharge products.

Figure 2A:
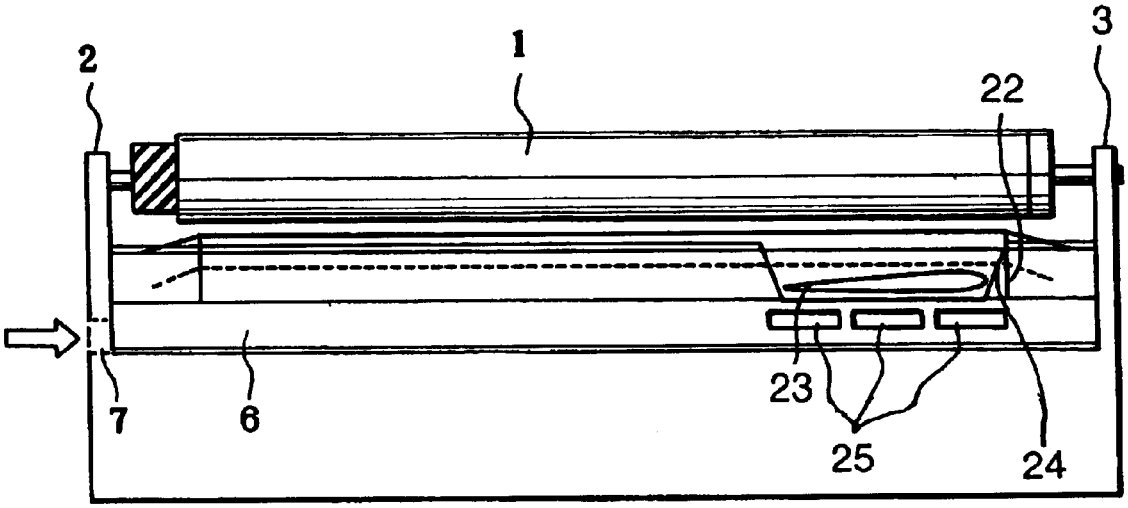
FIGS. 2(*a*), 2(*b*) are illustrations showing a second embodiment of an image forming apparatus of the present 15 invention.
Figure 2B:
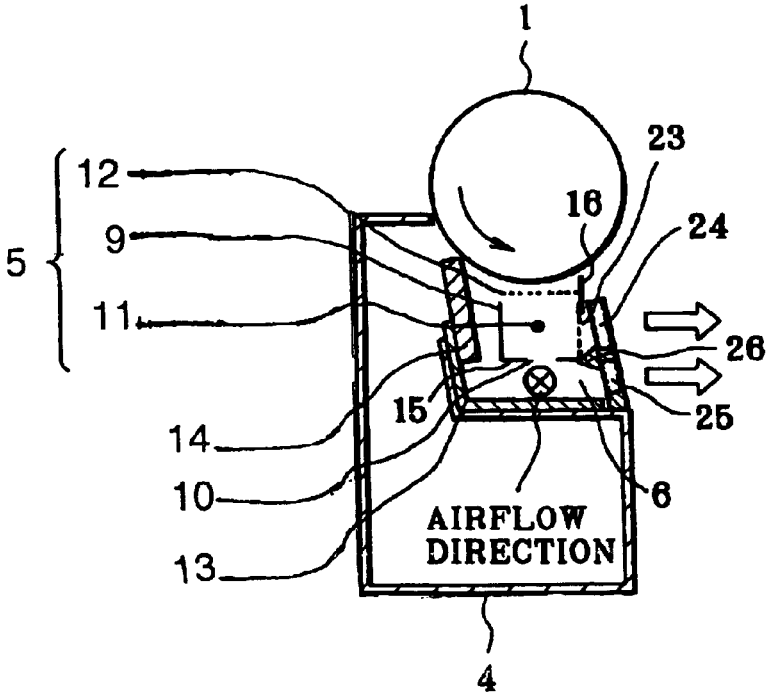

FIGS. 2(*a*), 2(*b*) are illustrations showing a second embodiment of an image forming apparatus of the present invention, wherein FIG. 2(*a*) is a longitudinal sectional view thereof and FIG. 2(*b*) is a cross sectional view thereof.

A drum-like image carrier 1 is rotatably supported by side plates 2, 3. In a cartridge 4 arranged facing the image carrier 1, a corona charger 5 is disposed and a duct 6 is disposed adjacent to the corona charger 5. The corona charger 5 comprises a discharge electrode 11 arranged to extend along the axial direction of the image carrier 1, a conductive shield 9 having a U-like section surrounding the discharge electrode 11, and a grid 12 formed on the open face of the conductive shield 9 facing the image carrier 1. The conductive shield 9 has a bottom opposite to the face in which the grid 12 is formed and has a ventilation opening 10 formed in the bottom to extend along the discharge electrode 11. The duct 6 is arranged to extend along the ventilation opening 10 and has an opening 7 formed in at least one of the side plates 2, 3. An air blower, which is not shown, is disposed to the opening 7 to send air into the duct 6 to create airflow in the conductive shield 9 through the ventilation opening 10. The duct 6 is provided with a supporting member 13 to which a cleaning blade 14 is mounted for cleaning residual toner on the surface of the image carrier 1 so that the residual toner is collected in the cartridge 4.

In the second embodiment, the conductive shield 9 has a face 16 which is other than the face with the grid 12 and the face with the ventilation opening 10 and which is on the downstream side in the rotational direction of the image carrier 1 and has a ventilation opening 23 formed in the face 16 on the downstream side in the direction of airflow. Since the ventilation opening 23 is formed in the face 16 on the downstream side in the rotational direction of the image carrier 1, wind created by the rotation of the image carrier 1 is effectively directed toward the ventilation opening 23. The ventilation opening 23 is designed in such a manner as to have a larger width as the position becomes nearer to the end on the downstream in the direction of airflow, thereby facilitating the exhaust of ozone staying downstream of airflow.

On the other hand, the duct 6 arranged adjacent to the conductive shield 9 is provided with a ventilation opening 24 being a cutout for example at a position facing the ventilation opening 23 so as to facilitate the exhaust of ozone in the conductive shield 9 out of the cartridge 4. In addition, ozone falls down automatically due to its weight through the ventilation opening 10 formed in the bottom of the conductive shield 9. For facilitating the exhaust of such ozone, ventilation openings 25, for example, composed of a plurality of holes as shown in FIG. 2(*a*) are formed in a portion of the duct 6 near the outlet.

As shown in FIGS. 2(*a*) and 2(*b*), the ventilation openings 25 are disposed at a position lower than that of the ventilation opening 24. The ventilation opening 24 and the ventilation opening 25 are segregated from each other by a partition 26 arranged therebetween, thereby preventing confluence between airflow exhausted with ozone through the ventilation opening 23 of the conductive shield 9 and airflow flowing in the duct 6 and preventing ozone from staying due to the confluence.

In case that a suction unit is disposed to face the ventilation openings 24, 25 formed to exhaust ozone out of the cartridge 4 and the ozone is sucked by the suction unit, the exhaust of ozone can be further effectively conducted.

Figure 3A:
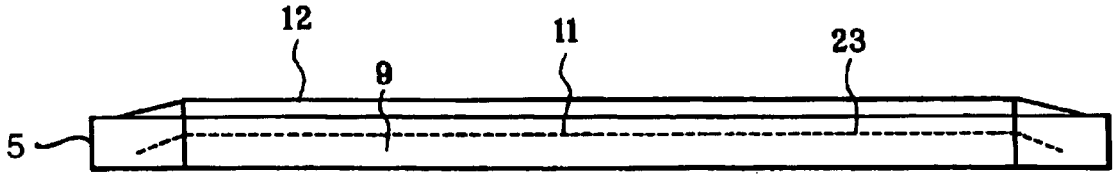
FIGS. 3(*a*)–3(*c*) are illustrations for explaining a ventilation opening formed in the bottom of a shield.
Figure 3B:
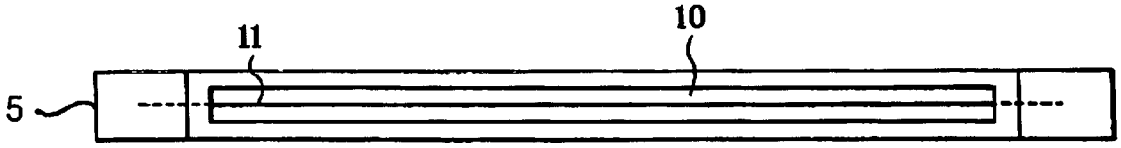
Figure 3C:
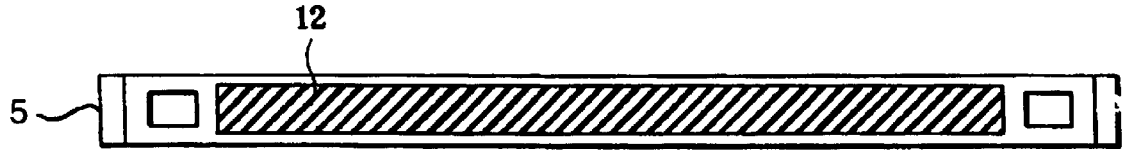

FIGS. 3(*a*)–3(*c*) are illustrations for explaining the ventilation opening 10 formed in the bottom of the conductive shield 9 shown in FIG. 2(*b*), wherein FIG. 3(*a*) is a side view of a corona charger 5, FIG. 3(*b*) is a bottom view of the corona charger 5, and FIG. 3(*c*) is a top view of the corona charger 5.

By forming the ventilation opening 23 of the conductive shield 9 in such a manner as to have a larger width as the position becomes nearer to the end on the downstream in the direction of airflow as shown in FIG. 3(*a*), the exhaust of ozone can be further effectively conducted. Though the ventilation opening 10 in the bottom of the conductive shield 9 is formed such that its width is constant in the illustrated example, the ventilation opening 10 may be formed in such a manner as to have a larger width as the position becomes nearer to the end on the downstream in the direction of airflow. According to this structure, ozone can effectively fall down automatically into the duct 6 at the downstream side where ozone should gather, thereby effectively exhausting ozone.

Though the example in which air is sent through the airflow inlet 7 has been described above, the duct 6 may be designed such that air may be sucked at the airflow inlet 7. Also according to this structure, the same effect can be obtained. In this case, the suction side becomes the downstream side in the direction of airflow and ozone is exhausted at the suction side, and the ventilation openings 23, 24, 25 are formed on the suction side.

According to the second embodiment as mentioned above, air sent from the airflow inlet 7 at the end of duct 6 is divided into a part of airflow directly flowing into the duct 6 and a part of airflow flowing into the conductive shield 9 through the ventilation opening 23 formed in the conductive shield 9. The air flowing in the conductive shield 9 is exhausted out of the conductive shield 9 through the ventilation opening 23 formed in the end on the downstream side in the direction of airflow together with ozone generated by discharge. As the duct 6 is provided with ventilation opening 25 at a position facing the ventilation opening 23 of the conductive shield 9 and a position near the outlet, respectively, ozone can be effectively exhausted by airflow exhausted from the conductive shield 9 and airflow flowing in the duct 6. Therefore, the adhesion of discharge products to the discharge electrode 11 can be prevented and the maintenance of well discharge can be achieved by a simple structure even under a low temperature and low humidity condition.

As the conductive shield 9 has a face which is on the downstream side in the rotational direction of the image carrier 1 and has a ventilation opening 23 formed in the face on the downstream side in the direction of airflow, wind created by the rotation of the image carrier 1 is effectively directed toward the ventilation opening 23, thereby further effectively exhausting ozone generated in the conductive shield 9 and thus further effectively preventing the adhesion of discharge products.

In addition, the ventilation opening 23 of the conductive shield 9 on the downstream side in the direction of airflow is designed in such a manner as to have a larger width as the position becomes nearer to the end on the downstream in the direction of airflow, thereby further effectively exhausting ozone created in the conductive shield 9.

Further, the ventilation openings 24, 25 separately formed in the duct 6 are segregated from each other by the partition 26 so as to prevent confluence between airflow exhausted from the conductive shield 9 and airflow flowing in the duct 6, thereby smoothly exhausting ozone.

Figure 4:
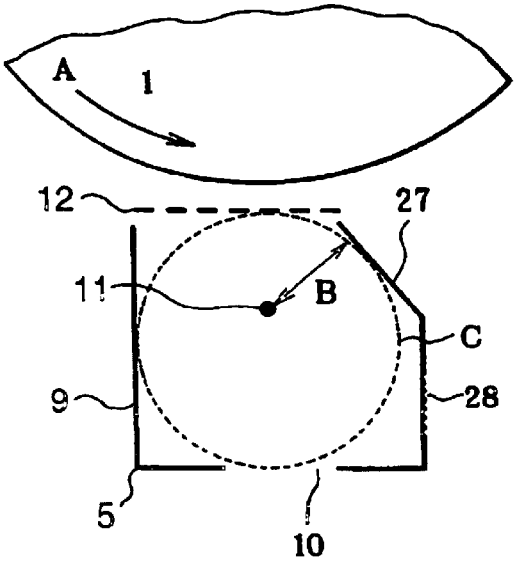
FIG. 4 is a conceptual illustration for explaining a third embodiment of an image forming apparatus of the present invention.

FIG. 4 is an illustration for explaining a third embodiment of an image forming apparatus of the present invention.

An image carrier 1 is composed of a drum-like rotatable member and, while rotating in a direction of arrow A, the surface of the image carrier 1 is uniformly charged by a corona charger 5 disposed to face the image carrier 1. The corona charger 5 comprises a conductive shield 9 having an open face facing the image carrier 1 and extending in the axial direction of the image carrier 1, a wire-like discharge electrode 11 inside the conductive shield 9, and a grid 12 formed in the open face facing the image carrier 1. A ventilation opening 10 is formed in a face opposite to the face, in which the grid 12 is formed, to extend along the axial direction so that air flowing in a duct (not shown) arranged along the ventilation opening 10 flows into the conductive shield 9 through the ventilation opening 10, thus creating airflow in the conductive shield 9.

In the third embodiment, between the wire-like discharge electrode 11 and the surface of the conductive shield 9 generating discharge, a proximate face 27 is formed at a position nearest to the discharge electrode 11 to facilitate discharge. For providing the proximate face 27, for example, the discharge electrode 11 is arranged at a position shifting toward the image carrier 1 side from the center between the face formed with the grid 12 and the face opposite to the face with the grid 12 and a part of a side of the conductive shield 9 which is the nearest to the image carrier 1 is folded inwards (toward the discharge electrode 11) to be inclined, thereby providing the proximate face 27. A circle C in FIG. 4 is an inscribed circle relative to two faces (the left side face and the bottom as seen in FIG. 4) and the proximate face 27 of the conductive shield 9. The discharge electrode 11 is shifted from the center of the circle C toward the image carrier 1. An arrow B indicates that the inclined face is the proximate face 27 to the discharge electrode 11. By providing the proximate face 27, discharge relative to the discharge electrode 11 is facilitated.

Differently from the proximate face 27 formed in the aforementioned manner, a ventilation opening 28 is formed in a face of the conductive shield 9 far from the discharge electrode 11. In the illustrated example, the ventilation opening 28 is formed in a portion far from the image carrier 1 (on the ventilation opening 10 side) of a side face, which is the same side of the proximate face 27 relative to the discharge electrode 11, of the conductive shield 9. Since ozone easily stays at the downstream side in the direction of airflow in the conductive shield 9, the ventilation opening 28 is preferably composed of one or a plurality of holes formed near the end on the downstream side in the direction of airflow or formed into an elongated hole shape having a larger width as the position becomes nearer to the end on the downstream in the direction of airflow.

In this manner, the discharge can be securely maintained by the proximate face 27 even though the ventilation opening 28 is formed in a face other than the proximate face 27. Therefore, the exhaust of ozone is achieved without affecting the discharge. When the image carrier 1 rotates in the direction of arrow A, the ventilation opening 28 is preferably arranged on the downstream side of the rotational direction of the image carrier 1. According to this arrangement of the ventilation opening 28, wind created by the rotation of the image carrier 1 is blown through the ventilation opening 28, thereby further effectively exhausting ozone.

As mentioned above, according to the third embodiment, the ventilation opening 28 is formed in a face other than the proximate face 27 relative to the discharge electrode, among the faces of the conductive shield 9 of the corona charger 5, so that stable discharge is maintained between the discharge electrode 11 and the proximate face 27 of the conductive shield 9, whereby the obtained image is not affected by the ventilation opening 28 formed in the face other than the proximate face 27. Since air can be blown into the conductive shield 9 while maintaining the stable discharge, the occurrence of image defects can be prevented and deterioration of the corona charger 5 due to ozone can be prevented.

Figure 5:
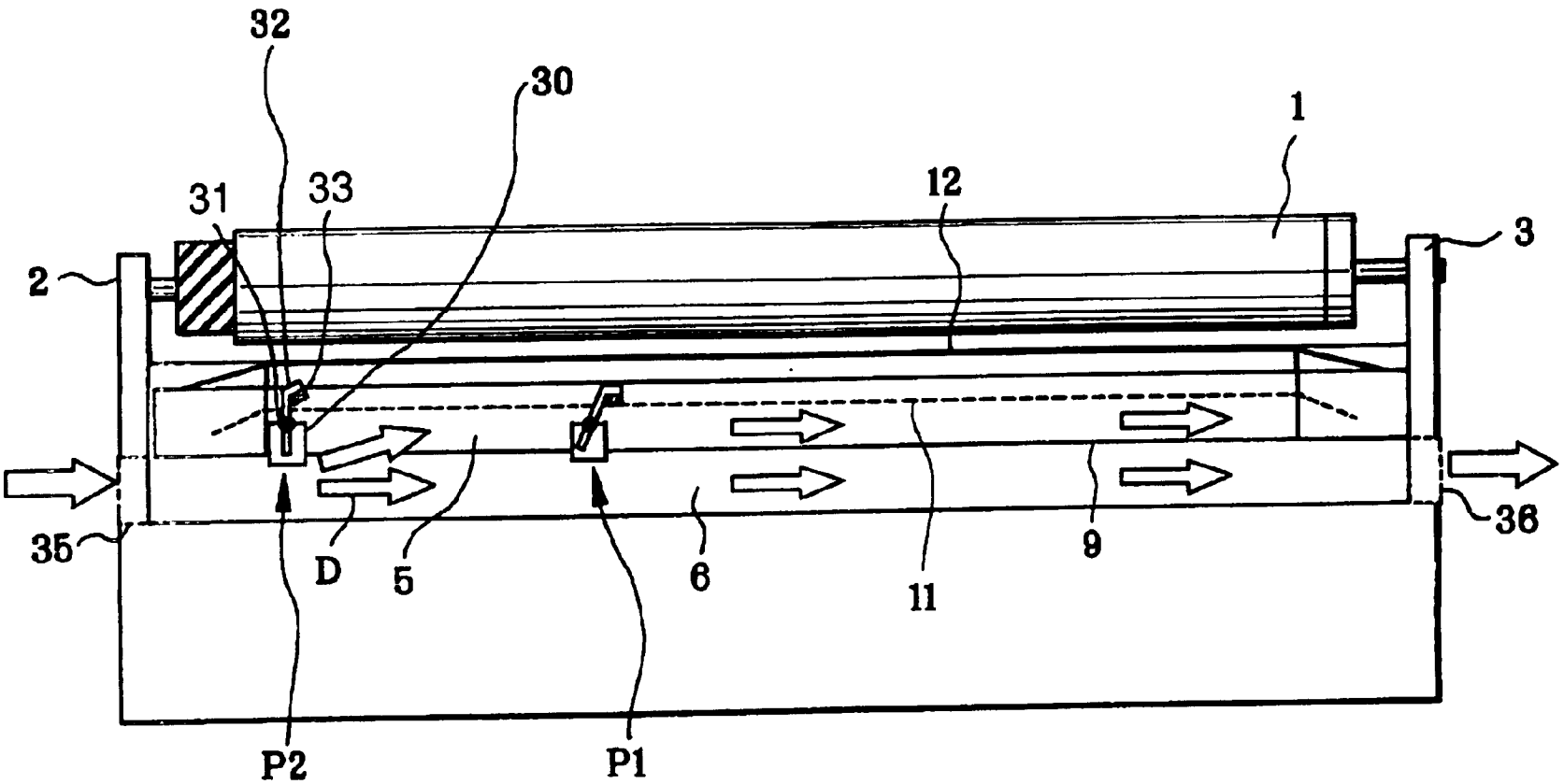
FIG. 5 is an illustration showing a fourth embodiment of an image forming apparatus of the present invention.

FIG. 5 is an illustration showing a fourth embodiment of an image forming apparatus of the present invention.

A drum-like image carrier 1 is rotatably supported by side plates 2, 3. A corona charger 5 is disposed to face the image carrier 1 and a duct 6 is disposed adjacent to the corona charger 5. The corona charger 5 comprises a discharge electrode 11 arranged along the axial direction of the image carrier 1, a conductive shield 9 having a U-like section surrounding the discharge electrode 11, and a grid 12 formed in the open face of the conductive shield 9 facing the image carrier 1. The conductive shield 9 is provided with a ventilation opening 10 (see, e.g. FIGS. 1(*b*), 2(*b*) and 4) formed in a face opposite to the open face in which the grid 12 is formed. The duct 6 is arranged adjacent to the ventilation opening 10 and has openings 35, 36 formed in the side plates 2, 3. An air blower, which is not shown, is disposed to one of the openings 35 (this opening may also be referred to as an "airflow inlet") to send air into the duct 6 so that the opening 35 functions as an airflow inlet and the opening 36 functions as an exhaust outlet. As air is sent from the airflow inlet 35 by the air blower, airflow is created in the duct 6 as shown by arrows D and, at the same time, airflow is also created in the conductive shield 9 through the ventilation opening 10 so that air is blown in the same direction as that in the duct 6. Accordingly, ozone generated in the conductive shield 9 due to discharge of the corona charger 5 gathers at the downstream side in the direction of airflow, is sent out into the duct 6, and is exhausted through the opening 36.

In the fourth embodiment, a cleaning lever supporting member 30 is supported by a supporting means (not shown) disposed to extend along the wire-like discharge electrode 11. A cleaning lever 32 is supported rotatably about a lever pivot 31 by the cleaning lever supporting member 30 and is provided at its end with a cleaning pad 33. For example, the cleaning pad 33 nips the discharge electrode 11 while being in contact with the discharge electrode 11 to remove contamination. The cleaning lever supporting member 30 is moved along the discharge electrode 11 manually or by a driving means (not shown), thereby removing dusts from the discharge electrode 11. P1 in FIG. 5 indicates a cleaning position of the cleaning lever supporting member 30 in a state that the cleaning lever supporting member 30 moves along the discharge electrode 11. The cleaning lever supporting member 30 when non-operating is positioned in the standby position P2 at the end on the upstream side in the direction of airflow. That is, the standby position P2 of the cleaning lever supporting member 30 is located at the end near the opening 35 when air is sent from the opening 35, while the standby position P2 of the cleaning lever supporting member 30 is located at the end near the opening 36 when suction is conducted at the opening 35. Since scattered toner and ozone generated by discharge are sent to the downstream side in the direction of airflow during the image forming process and the cleaning lever supporting member 30 is positioned at the end on the upstream side in the direction of airflow when it stands by, the cleaning pad 33 is not contaminated by the scattered toner and the ozone. The discharge electrode 11 is cleaned by the cleaning pad 33 which has not been contaminated when it is inoperative, thereby ensuring the maintenance of well discharge.

Since the cleaning pad 33 is made of insulating material such as felt or artificial leather, the contact between the discharge electrode 11 and the cleaning pad 33 when it is inoperative makes the discharge around the contact portion unstable. Counting on this, the axial length of the corona charger 5 should be set to be long. In this embodiment, when the cleaning lever supporting member 30 is at the standby position P2, the cleaning pad 33 is spaced apart from the discharge electrode 11 not to affect the discharge. In this case, the cleaning pad 33 is spaced apart from the discharge electrode 11 in a suitable manner, for example, that the cleaning pad 33 is moved upward as well as spaced apart from the discharge electrode 11. By spacing the cleaning pad 33 apart from the discharge electrode 11 when it is in the standby position P2, a portion of the discharge electrode 11 corresponding to the standby position can effectively charge the image carrier 1.

According to the fourth embodiment as mentioned above, the cleaning pad 33 for the discharge electrode 11 can be prevented from being contaminated during the image forming process so as to keep the cleaning capacity of the cleaning pad 33 until the cleaning operation, thereby well cleaning the discharge electrode 11.

Since the cleaning pad 33 for the discharge electrode 11 is generally made of insulating material such as felt or artificial leather, the contact between the discharge electrode 11 and the cleaning pad 33 when it is inoperative makes the discharge around the contact portion unstable. Counting on this, conventionally, the axial length of the corona charger 5 should be set to be long. However, according to the present invention, the portion corresponding to the standby position P2 can be used for forming an image because the cleaning pad 33 is spaced apart from the discharge electrode 11 at the standby position P2, it is not required to make the axial length of the corona charger 5 long, thereby enabling the reduction in size of the apparatus.

I claim:

1. An image forming apparatus including at least:

an image carrier which is movable;

a corona charger which is arranged to face said image carrier and comprises a conductive shield having an open face on a side facing said image carrier and a face which is opposite to the open face and has a first ventilation opening, and a discharge electrode arranged in said conductive shield; and a duct which is arranged adjacent to said corona charger and is provided with an airflow opening in one of ends thereof in the axial direction of said image carrier, wherein air is sent or sucked through the airflow opening which is formed in one of the ends of said duct in the axial direction of the image carrier, said image forming apparatus being characterized in that said conductive shield is provided with second ventilation opening in a face other than the open face facing said image carrier and the face opposite to the open face on the downstream side in the direction of airflow, and said duct has a third ventilation opening at a position facing said second ventilation opening of said conductive shield and a fourth ventilation opening in a face of said duct, in which the third ventilation opening is formed, near the outlet of the duct.

2. An image forming apparatus as claimed in claim 1, wherein the face of said conductive shield in which the second ventilation opening is formed is located on the downstream side in the rotational direction of the image carrier.

3. An image forming apparatus as claimed in claim 1 or 2, wherein the second ventilation opening of said conductive shield is formed in such a manner as to have a larger width as the position becomes nearer to the end on the downstream side in the direction of airflow.

4. An image forming apparatus as claimed in claim 1, further comprising a partition between said third ventilation opening and said fourth ventilation opening of said duct.

5. The image forming apparatus of claim 1, wherein the fourth ventilation opening comprises a plurality of holes formed in a portion of said duct, near said outlet.

6. The image forming apparatus of claim 1, wherein the third ventilation opening comprises a cutout position facing the second ventilation opening.

7. The image forming apparatus of claim 1, wherein the fourth ventilation opening is disposed at a position lower than the third ventilation opening.

* * * * *